US007350691B2

(12) United States Patent
Monette et al.

(10) Patent No.: US 7,350,691 B2
(45) Date of Patent: Apr. 1, 2008

(54) MAILBOX

(76) Inventors: Albert A Monette, 735 Saint Bernard St., Marysville, MI (US) 48040-1323; Janice I Monette, 735 Saint Bernard St., Marysville, MI (US) 48040-1323

( * ) Notice: Subject to any disclaimer, the term of this patent is extended or adjusted under 35 U.S.C. 154(b) by 282 days.

(21) Appl. No.: 10/799,108

(22) Filed: Mar. 12, 2004

(65) Prior Publication Data

US 2004/0232215 A1 Nov. 25, 2004

Related U.S. Application Data

(60) Provisional application No. 60/454,072, filed on Mar. 12, 2003.

(51) Int. Cl.
*A47G 29/12* (2006.01)

(52) U.S. Cl. ..... 232/38; 232/45

(58) Field of Classification Search ..... 232/17, 232/38, 45, 43.1, 43.4
See application file for complete search history.

(56) References Cited

U.S. PATENT DOCUMENTS

| | | | | |
|---|---|---|---|---|
| 1,239,733 | A | 9/1917 | Sickels | |
| 1,393,944 | A | 10/1921 | Chapman | |
| 1,959,963 | A | 5/1934 | Overmyer | |
| 2,370,682 | A | 3/1945 | Overmyer | |
| 2,552,628 | A | 5/1951 | Gallaher | |
| 2,561,007 | A | 7/1951 | Bierig | |
| 3,107,848 | A | 10/1963 | Penta | |
| 3,707,260 | A * | 12/1972 | Gelineau et al. | 232/36 |
| 4,244,512 | A | 1/1981 | Wise | |
| 4,359,185 | A * | 11/1982 | Castro | 232/17 |
| 4,872,610 | A | 10/1989 | Grabowiecki | |
| 5,011,039 | A | 4/1991 | Crow | |
| 5,056,711 | A | 10/1991 | Bush | |
| 5,346,125 | A | 9/1994 | Critzer, Sr. | |
| 5,425,501 | A | 6/1995 | Wesorick | |
| 5,673,509 | A * | 10/1997 | Gatewood, Jr. | 43/58 |
| 5,769,312 | A | 6/1998 | Lampe | |
| 5,927,596 | A | 7/1999 | Trenier | |
| D471,691 | S * | 3/2003 | Ducolon | D99/29 |
| 6,629,634 | B2 * | 10/2003 | Simmons | 232/45 |
| 6,845,904 | B1 * | 1/2005 | South | 232/38 |
| 2003/0136823 | A1 * | 7/2003 | Felice et al. | 232/30 |
| 2003/0205614 | A1 * | 11/2003 | Klima et al. | 232/38 |
| 2003/0213837 | A1 * | 11/2003 | Morgan | 232/38 |
| 2004/0011863 | A1 * | 1/2004 | Brooks | 232/38 |

* cited by examiner

*Primary Examiner*—William L. Miller
(74) *Attorney, Agent, or Firm*—Jeffrey Schox

(57) ABSTRACT

The preferred mailbox of the invention includes a body and a first door. The body preferably defines a first opening adapted to receive a mail item, and a cavity adapted to contain the mail item. The body also includes a primary section that substantially prevents light from entering into the cavity, and a secondary section that substantially allows light to enter into the cavity. The first door is preferably coupled to the body and adapted for movement between an open position that allows access through the first opening into the cavity and a closed position that prevents access through the first opening. In the closed position, the first door substantially allows viewing of the cavity.

15 Claims, 1 Drawing Sheet

MAILBOX

CROSS-REFERENCE TO RELATED APPLICATIONS

The present invention claims priority to US Provisional Application Ser. No. 60/454,072 entitled "Mailbox Inspection Device" and filed 12 Mar. 2003.

TECHNICAL FIELD

The present invention generally relates to mailboxes. More specifically, the present invention relates to a mailbox with a door that substantially allows viewing of the cavity in the closed position.

BACKGROUND

Current mailboxes provide either the benefit of substantial visual access to the interior chamber of the mailbox, or the benefit of extensive privacy for the contents of the chamber, but not both. Mailbox users may be exposed to dangerous contents within the mailbox chamber, such as explosive devices triggered to detonate when the mailbox door is opened. Therefore, it is advantageous for a mailbox to allow a visual inspection of the contents of a mailbox chamber without opening the mailbox door. Additionally, mailboxes are often visually and physically accessible to the general public, rendering the contents of the mailbox susceptible to theft and/or public scrutiny. As a result, it is also advantageous to provide privacy for the contents of the mailbox chamber by limiting visual access to mailbox chamber. A conflict exists between the advantages of providing visual inspection of the internal chamber for mailbox users such as mailbox owners and postal carriers, and the disadvantages of providing visual access to non-users such as members of the general public.

Thus, there is a need for a mailbox that includes a primary section that substantially prevents light from entering into the cavity, yet includes another portion that substantially allows viewing of the cavity in the closed position. The present invention provides such an invention.

DETAILED DESCRIPTION OF THE PREFERRED EMBODIMENTS

The following description of two preferred embodiments of the invention is not intended to limit the invention to these preferred embodiments, but rather to enable any person skilled in the art to make and use this invention.

Figure 1:
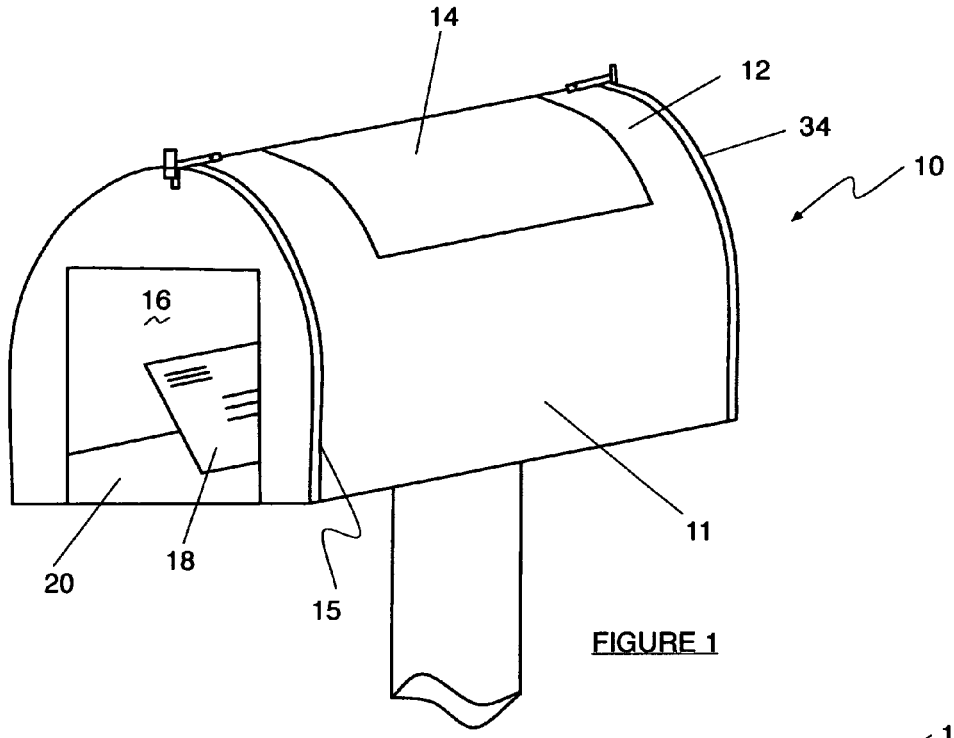
FIG. 1 is a perspective view of the first preferred embodiment of the invention.

As shown in FIG. 1, the first preferred embodiment of the present invention is a mailbox 10 including a body 11 with a primary section 12 and a translucent secondary section 14, and a first door 15. Preferably, the primary section 12 is composed of a substantially opaque material such as plastic or metal, while the translucent secondary section 14 is composed of a substantially translucent material, such as frosted, shaded or pebbled glass, Plexiglas, or plastic. The primary section 12 and the translucent secondary section 14 are preferably integrally formed, but may alternatively be separately formed and later joined. The first door 15 preferably includes at least one transparent section 16 composed of a substantially transparent material, such as glass, Plexiglas, or plastic. The transparent section 16 allows visual inspection of the contents 18 of the mailbox 10, and the translucent secondary section 14 permits light to enter the internal chamber 20 of the mailbox 10. Preferably, the translucent secondary section 14 diffuses the light such that the contents 18 of the mailbox 10 cannot actually be viewed through the translucent secondary section 14, while improving the view through the transparent section 16. The secondary translucent section 14 may be located anywhere on the mailbox, such as the sides, the top, the bottom, or a combination of these locations and may be shaped in any suitable fashion, such as small circles, long rectangles, or any other appropriate shape. The combination of at least one transparent section 16 and at least one translucent secondary section 14 improves the visibility of the internal chamber 20 while maintaining the privacy of the contents 18 of the mailbox 10.

The transparent section 16 of the first door 15 is preferably located such that the mailbox owner can easily see the contents 18 of the mailbox 10, and such that the general public will not easily view the contents 18 of the mailbox 10. For example, if the mailbox 10 is located between a mailbox owner's house and the road, the mailbox owner walking from his or her house towards the mailbox 10 will easily see the contents 18 if the transparent section 16 is located on the first door 15. Likewise, car passengers and pedestrians walking along the road are less likely to view the contents 18 of the mailbox 10 if the transparent section 16 is located on the first door 15. The transparent section 16 may alternatively be located on any other suitable portion of the mailbox. Additionally, the first door 15 may be composed entirely a transparent material so as to provide the transparent section 16.

In a variation of the first preferred embodiment, the mailbox 10 includes a body 11 with a primary section 12 and a secondary transparent section 14, and a first door 15 including a transparent section 16. Both the secondary transparent section 14 and the transparent section 16 are preferably composed of material that is substantially transparent, such as glass, Plexiglas, or plastic. In this variation of the preferred embodiment of the mailbox 10, the primary section 12 is made of an opaque material in order to provide privacy for the contents 18 of the mailbox 10. The transparent section 16 is preferably located such that the mailbox owner can easily see the contents 18 of the mailbox 10, and such that the general public will not easily view the contents 18 of the mailbox 10. The transparent secondary section 14 is preferably located so as to maximize the amount of light that enters the mailbox 10 (either from the sun or from a flashlight), minimize the visibility of the contents 18 of the mailbox 10 from the general public, and increase the visibility of the contents 18 to the owner. In all other respects, the mailbox of the first variation of the first preferred embodiment is substantially similar to the mailbox of the first preferred embodiment.

Figure 2:
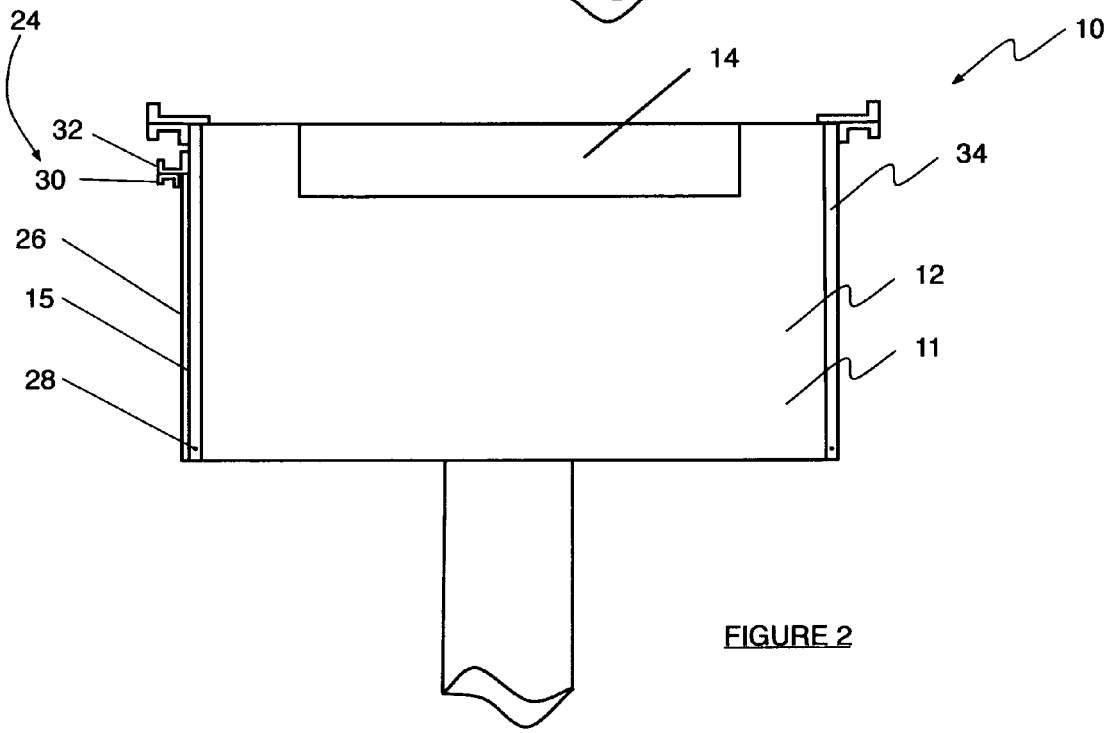
FIG. 2 is a side view of the second preferred embodiment of the invention.

As shown in FIG. 2, the second preferred embodiment of the present invention is a mailbox 10 that further includes a privacy device 24, such as a privacy door 26, which permits a mailbox user to open and view the contents of the mailbox 10 without actually opening the mailbox 10. The privacy door 26 is preferably comprised of an opaque or a translucent material, and it is preferably located such that it substantially covers a transparent section of the mailbox, such as the first door 15. The privacy door 26 will therefore limit the visibility of the contents of the mailbox 10 when the privacy door 26 is closed (shown in the closed position in FIG. 2), and the mailbox contents will be visible through the transparent section when the privacy door 26 is open. In one variation of the second preferred embodiment, the first door 15 is exposed when the privacy door 26 is open, but when the privacy door 26 is closed then the first door 15 is substantially covered. The privacy door 26 may be connected to the mailbox 10 via a hinge mechanism 28 with a first latch 30 and a second latch 32, or by other means such as a sliding door, a pivoting panel, or a device similar to window blinds or shades. In all other respects, the mailbox of the second preferred embodiment is substantially similar to the mailbox of the first preferred embodiment.

In another variation of the preferred embodiments, the mailbox 10 includes a second door 34. A mail carrier typically deposits the mail into the mailbox through the second door 34, and the mailbox owner typically retrieves the mail through the first door 15. The second door 34 preferably includes a handle or a latch mechanism, and the first door 15 is preferably located on the side of the mailbox that faces away from the road so the mailbox owner can keep a safe distance from the road. The second door preferably prevents viewing of the cavity in the closed position and, thus, is preferably made of an opaque or translucent plastic material. The second door may, however, allow viewing of the cavity in the closed position and, for this reason, may be made of a transparent plastic material.

The present invention may be marketed as a "replacement kit" for a mailbox, such as replacement door(s) that act as mailbox inspection devices. The purchaser can connect the new mailbox door(s) with the already-owned mailbox. The replacement kit may also include other sufficient means of adapting an already-owned mailbox to include a mailbox inspection device, such as a mechanism to remove an opaque section of a mailbox and insert a transparent section.

As a person skilled in the art will recognize from the previous detailed description and from the figures and claims, modifications and changes can be made to the preferred embodiments of the invention without departing from the scope of this invention defined in the following claims.

We claim:

1. A mailbox comprising: a body defining a first opening adapted to receive a mail item, defining a cavity adapted to contain the mail item, having an opaque primary section that substantially prevents light from entering into the cavity, and having a translucent secondary section made from a material selected from the group consisting of frosted, shaded, and pebbled that substantially prevents viewing of the cavity; and a first door coupled to the body and adapted for movement between an open position that allows access through the first opening into the cavity and a closed position that prevents access through the first opening, wherein at least a portion of the first door is transparent, wherein the translucent secondary section of the body and the transparent portion of the first door cooperate to allow light to enter into the cavity and exit through the transparent portion of the first door and substantially allow viewing of the cavity with the first door in the closed position.

2. The mailbox of claim 1 wherein the primary section and the secondary section are integrally connected as one unit.

3. The mailbox of claim 1, further comprising a privacy door coupled to the body adjacent the first door and adapted for movement between an open position and a closed position, wherein the privacy door substantially prevents viewing of the cavity in the closed position.

4. The mailbox of claim 3 wherein the first door and the privacy door allow access through the first opening into the cavity when the first door and the privacy door are in the open position.

5. The mailbox of claim 4 wherein the first door and the privacy door allow viewing of the cavity and prevent access through the first opening when the first door is the in the closed position and the privacy door is in the open position.

6. The mailbox of claim 1 wherein the body further defines a second opening adapted to receive a mail item.

7. The mailbox of claim 6 further comprising a second door coupled to the body and adapted for movement between an open position that allows access through the second opening into the cavity and a closed position that prevents access through the second opening.

8. The mailbox of claim 7 wherein the second door is substantially opaque and substantially prevents viewing of the cavity in the closed position.

9. The mailbox of claim 7 wherein the second door is made of an opaque plastic material.

10. The mailbox of claim 7 wherein the second door is made of a translucent plastic material.

11. The mailbox of claim 7 wherein at least a portion of the second door is transparent and substantially allows viewing of the cavity in the closed position.

12. The mailbox of claim 7 wherein the second door is made of a transparent plastic material.

13. The mailbox of claim 1 wherein the secondary section is made of plastic material.

14. The mailbox of claim 13 wherein the secondary section is located on a top portion of the mailbox.

15. The mailbox of claim 14 wherein the secondary section is shaped in the form of a rectangle.

* * * * *